US006082599A

United States Patent [19]

Richard

[11] Patent Number: 6,082,599

[45] Date of Patent: Jul. 4, 2000

[54] INTERNAL NOZZLE/PLATE ASSEMBLY COMPRISING A WEAKENED PORTION

[75] Inventor: François-Noël Richard, Nancy, France

[73] Assignee: Vesuvius France SA, Feignies, France

[21] Appl. No.: 08/973,107

[22] PCT Filed: Jun. 28, 1996

[86] PCT No.: PCT/FR96/01017

§ 371 Date: Feb. 11, 1998

§ 102(e) Date: Feb. 11, 1998

[87] PCT Pub. No.: WO97/02104

PCT Pub. Date: Jan. 23, 1997

[30] Foreign Application Priority Data

Jul. 3, 1995 [FR] France ..... 95 08088

[51] Int. Cl.[7] ..... B22D 41/08

[52] U.S. Cl. ..... 222/600; 222/591

[58] Field of Search ..... 222/600, 591, 222/597, 590

[56] References Cited

U.S. PATENT DOCUMENTS

| | | | |
|---|---|---|---|
| 3,731,912 | 5/1973 | Kutzer | 222/600 |
| 4,091,971 | 5/1978 | Tinnes et al. | 222/600 |
| 4,566,925 | 1/1986 | Schnabel et al. . | |
| 4,708,327 | 11/1987 | Waltenspuhl . | |
| 5,044,533 | 9/1991 | King | 222/591 |
| 5,118,743 | 6/1992 | Yonezu et al. . | |
| 5,431,374 | 7/1995 | Janssen et al. | 222/600 |

FOREIGN PATENT DOCUMENTS

| | | |
|---|---|---|
| 2643001 | 8/1990 | France . |
| 4328032 | 3/1994 | Germany . |

*Primary Examiner*—Scott Kastler
*Attorney, Agent, or Firm*—Sixbey Friedman Leedom & Ferguson; Thomas W. Cole

[57] ABSTRACT

An internal nozzle/plate assembly for a distributor, wherein the plate is placed against a support (13) with an aperture (30) therein. A central portion is arranged opposite the aperture (30) and a peripheral portion is placed against the support (13). The central and peripheral portions are linked via a weakened portion (32) so that the central portion may be separated from the peripheral portion by exerting a slight force. A metal shell (22) partially surrounds said central and peripheral portions and the weakened portion (32) may be formed from a scored or notched portion in the shell.

8 Claims, 3 Drawing Sheets

FIG.2a
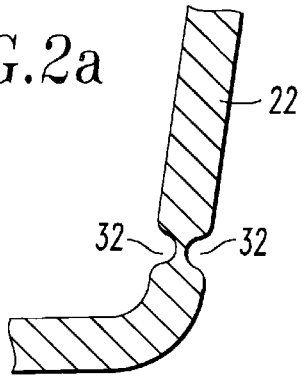
FIG.2b
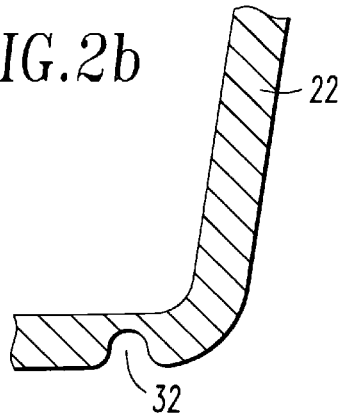
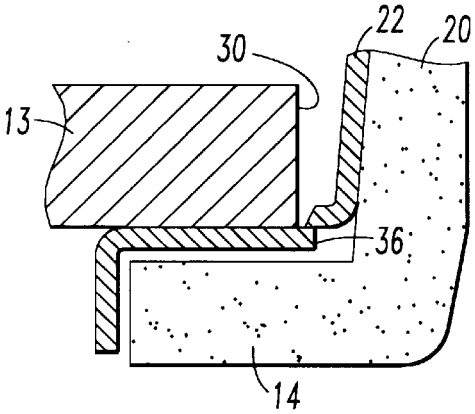
FIG.3
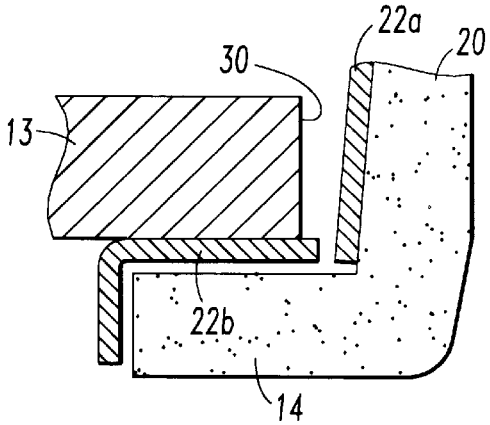
FIG.4
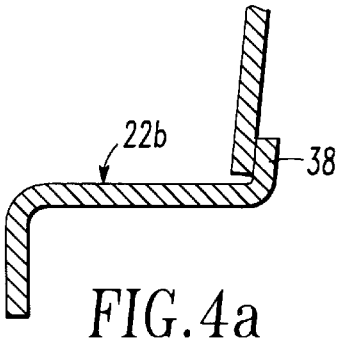
FIG.4a
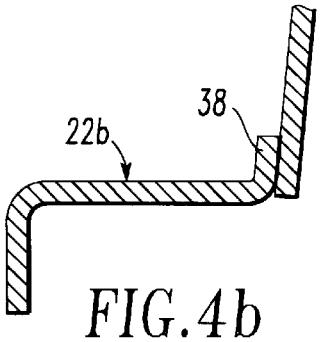
FIG.4b FIG.5
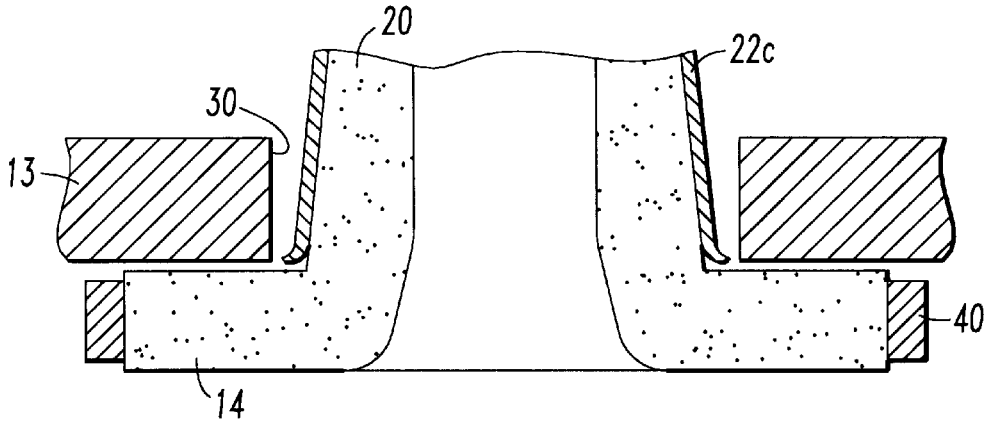
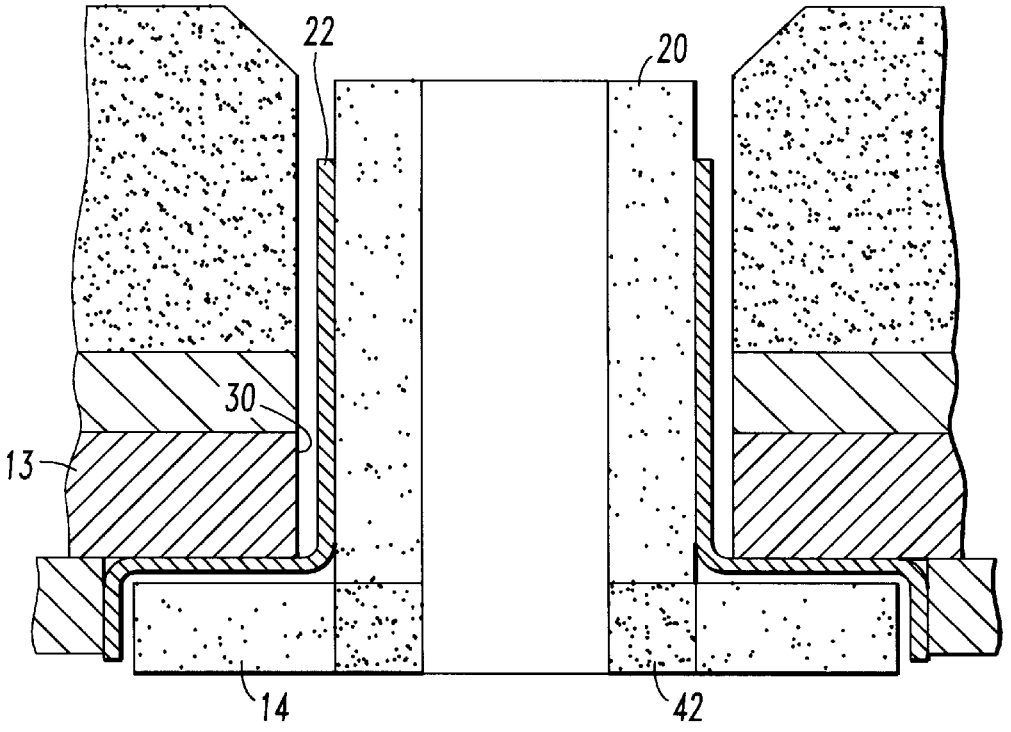
FIG.6

INTERNAL NOZZLE/PLATE ASSEMBLY COMPRISING A WEAKENED PORTION

This invention relates to a plate—internal nozzle assembly for a distributor, the plate being designed to be applied against a support in which there is an orifice.

In continuous steel pouring, a slide shutter is frequently used to control the steel flow between the distributor and one and several continuous pour molds. A slide shutter contains at least one fixed refractory plate installed under a support plate and at least one metal plate free to move with respect to the fixed plate. Each of these plates has at least one hole to allow the steel to pass. The upper plate is used with an internal nozzle that passes through the support plate and the bottom of the distributor. P At the end of the pour sequence, the slag that floats on the steel surface has to be prevented from entering into the mold. This is why the steel shutter is closed when there is still a certain amount of liquid steel, called the skull, in the distributor. This skull cools and solidifies.

Due to the gradual opening up of the hole in the internal nozzle by erosion, the lower end of the solidified steel rod that forms inside the pouring channel up to the mobile plate is in the shape of an elephant's foot which anchors the skull into the fixed plate of the slide shutter. When the distributor is fitted with several pour lines, each line leads to the formation of a skull anchored in the distributor. When the distributor is turned over, the steel rod(s) have to be broken so that the skull can be separated from the distributor. The internal nozzle must be pushed inside the distributor with the skull. This problem is aggravated when there are several pour lines because the steel contracts while it cools, such that the solidified steel rods tend to move towards each other. Since these rods are cast into the distributor wall, they apply pressure on the part of the distributor located between them.

Furthermore, the fixed plate and the internal nozzle are frequently assembled in a metal casing that seals the nozzle when a neutral gas is injected into the pour channel, and facilitates their manipulation during assembly. The presence of this metal casing reinforces the plate and internal nozzle assembly. It is very difficult to destroy the fixed plate and the internal nozzle when the skull is pushed towards the inside of the distributor, because this means extruding the metal casing through the orifice provided in the support on which the fixed plate is applied.

The purpose of this invention is to make a plate-internal nozzle assembly which solves this problem.

In accordance with the invention, the plate and nozzle assembly includes a central area facing the support orifice and a peripheral area applied on the support, the central area and the peripheral area being joined by a connection that is mechanically weaker than either the central area or peripheral area of the assembly such that the central area can be separated from the peripheral area by applying a small force.

According to a first embodiment, a metal casing surrounds the central area and the peripheral area, and the casing includes a weakened area, particularly by punching or notching. As an alternative the casing consists of two separate parts, namely one part partially surrounding the peripheral area and one part partially surrounding the central area.

In the second embodiment, a metal casing partially surrounds the internal nozzle, and a hoop encircles the plate.

In a specific embodiment the internal nozzle contains an outside cylindrical or slightly tapered wall, this wall being surrounded by a metal casing.

In another specific embodiment, the plate contains an insert located in the central part of the plate in which the outside diameter is smaller than the diameter provided in the support plate.

BRIEF DESCRIPTION OF THE DRAWINGS

Other characteristics and advantages of this invention will become clear when reading the following description of example embodiments given for illustration purposes with the reference to the figures in the appendix.

On these figures:

FIG. 2*a* and 2*b* are detailed views showing variations in the method of construction of the assembly shown in FIG. 2;

FIG. 3 is a view of a variant of the method of construction shown in FIGS. 1 and 2;

FIG. 4 is a view of another method of construction;

FIG. 4*a* and 4*b* are detailed views showing alternatives of the method of construction in FIG. 4;

FIG. 5 is a sectional view of a third embodiment of the invention;

FIG. 6 is a sectional view of a fourth embodiment of the invention.

FIG. 1 shows a sectional view of a continuous pour distributor referred to as reference 2, under which a slide shutter 4 is installed. The distributor 2 consists of a steel wall 6 covered by a refractory coating 8. A seating brick 10 is installed in the coating 8 at the bottom of the distributor. The slide shutter 4 includes a frame 12 fixed under a support plate 13 installed under the distributor.

Figure 1:
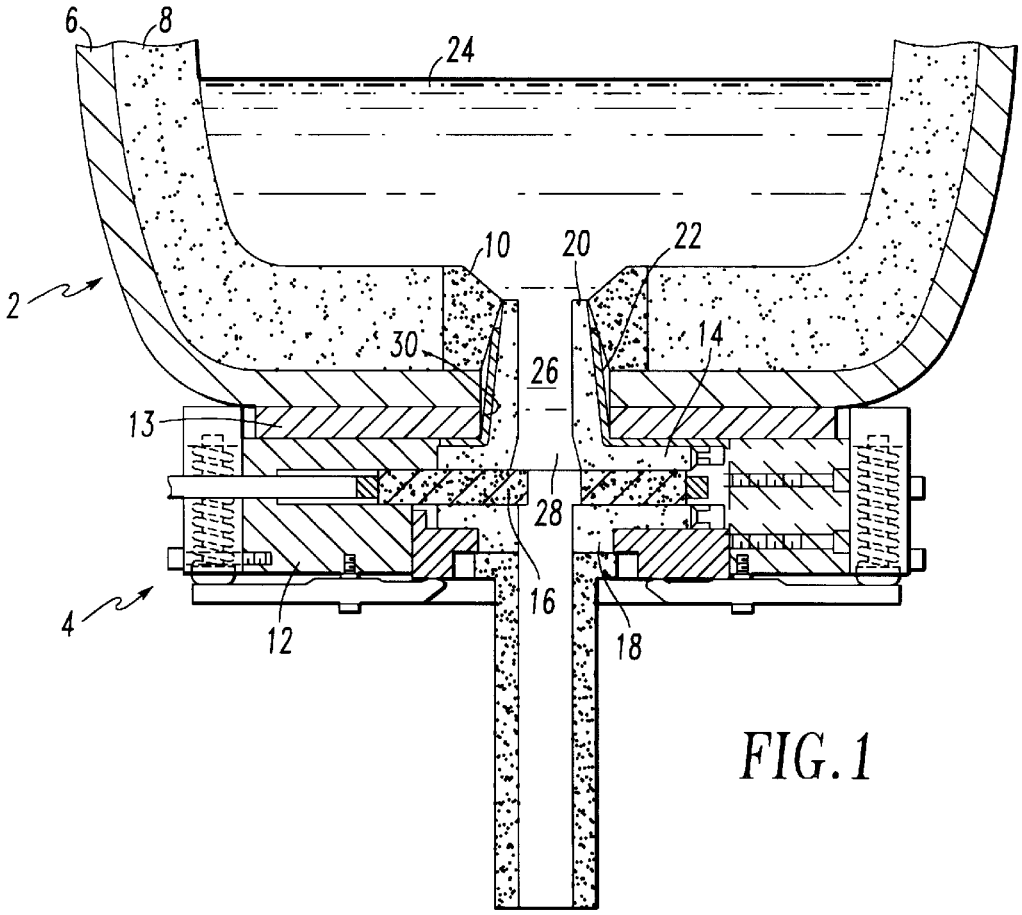
FIG. 1 is a sectional view of a distributor slide shutter in which a fixed plate/internal nozzle assembly is installed.

Three refractory plates are installed in frame 12, namely a fixed upper plate 14, a mobile plate 16 and a fixed lower plate 18.

An internal nozzle 20 is installed with the fixed upper plate 14 in a metal casing 22. The internal nozzle 20, plates 14, 16 and 18 contain holes that form a pour channel along which steel passes from the distributor to a continuous pouring mold (not shown). At the end of the pouring sequence, the slag floating on the surface of the steel 24 contained in the distributor must not pass into the mold. For this reason, this slide is closed by offsetting the mobile plate 16 with respect to the fixed plate 14 in order to interrupt the continuity of the pour channel. When this operation is finished, the liquid steel starts to cool and solidify, particularly in the channel of the internal nozzle 20 due to the small diameter of this channel. Solidified steel forms in it, which anchors skull 24 in distributor 2. Due to erosion of the internal nozzle 20 during the pour, the lower end of the solidified steel rod 26 has a tapered shape 28, in the form of an elephant's foot that increases the bond of the skull. This is why when the distributor 2 is turned over to pull out the skull, the skull will not fall but remains attached by the rod(s) 26. After removing the slide shutter which leaves the support plate and the plate-internal nozzle assembly on the distributor, it is then necessary to exert a very high pressure on the steel rod 26 so as to break the fixed plate 14 and the internal nozzle 20, and to extrude the metal casing 22 through the hole 30 provided in the support plate 13.

The purpose of the invention is to propose a plate/internal nozzle assembly that facilitates the operation of removing the skull. In accordance with the invention, the plate 14/internal nozzle 20 assembly has a central hole facing the orifice 30 in the support plate 13, and a peripheral area applied on support plate 13. The central area and the peripheral area are connected together through an area of least resistance. In the example embodiment shown in FIG. 2, the metal casing 22 has a circular notch 32 at the junction between the fixed plate 14 and the internal nozzle 20. This notch may be made in the approximately vertical part of the metal casing 22 as shown on FIG. 2, or on the horizontal part of this casing immediately adjacent to the connection of these two parts. Due to the presence of this notch, the metal casing 22 easily breaks when a relatively small force is applied on steel rod 26. The central part of the metal casing 22 penetrates into the distributor. The peripheral part remains at the outside on the fixed plate.

If the plate 14/internal nozzle 20 assembly is made in two assembled parts, these two parts separate. If the plate 14 and internal nozzle 20 are made into an assembly of a single part (monoblock assembly), the refractory material breaks relatively easily. The presence of the notch 32 thus makes it very much easier to remove the skull.

FIG. 2*a* and 2*b* show two alternative ways of making the notch 32. On FIG. 2*a*, the metal casing 22 is notched on each side of its surface on the vertical part surrounding the internal nozzle. On FIG. 2*b*, the metal casing 22 is notched at the horizontal surface which surrounds the fixed plate 14.

Figure 2:
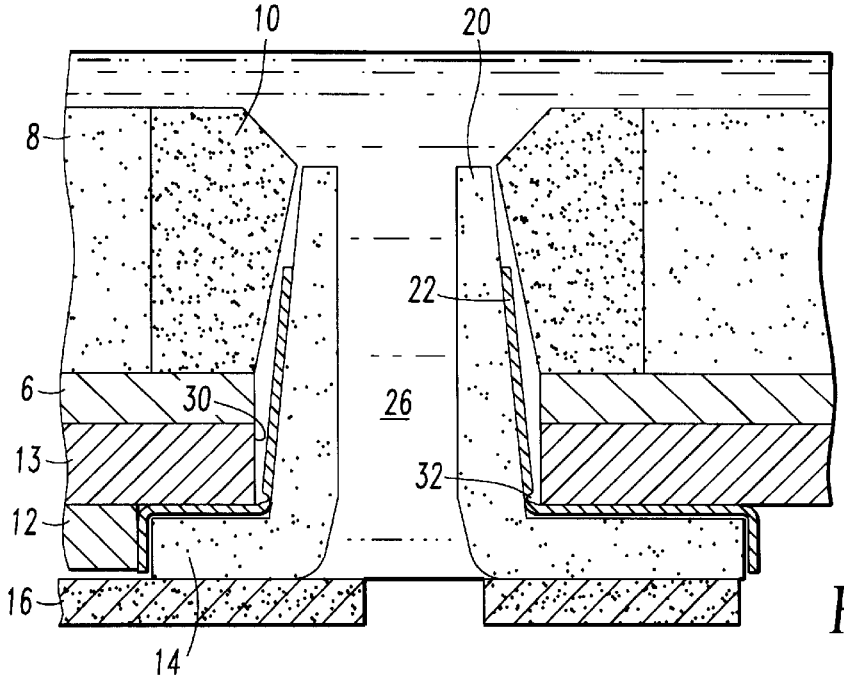
FIG. 2 is a view of a plate/internal nozzle assembly in accordance with the invention.

FIG. 3 shows an alternative embodiment of the assembly shown on FIGS. 1 and 2. In this alternative, the metal casing 22 is stamped at the junction between its horizontal part and its approximately vertical part, in order to form a weak point 36.

FIG. 4 shows another embodiment of the invention. The metal casing 22 consists of a part 22*a* that surrounds the internal nozzle 20, and a part 22*b* which surrounds the fixed plate 14. These two parts can be separated easily. All that is necessary to remove the skull is to separate the internal nozzle from plate 14 (two-piece assembly) or to break the refractory material (single-piece assembly) which requires very little force. FIGS. 4*a* and 4*b* show two alternatives of the embodiment shown in FIG. 4. Part 22*b* of the metal casing 22 contains a vertical upstand 38. Part 22*a* of the metal casing applies pressure on the edge of this vertical upstand 38 (FIG. 4*a*) or on the inside of the edge 38 (FIG. 4*b*).

FIG. 5 shows a third embodiment of the invention. The metal casing consists of a single part 22*c* that surrounds the internal nozzle 20 only. The fixed plate 14 is not surrounded by a metal casing, but simply by a hoop 40. Since the metal casing 22*c* and the hoop 40 are independent and separate, it is easy to pass the central part of the plate/internal nozzle assembly through the hole 30 formed in plate 13, in exactly the same way as for the embodiment shown in FIG. 4.

FIG. 6 shows a third embodiment of the invention. The outside wall of the nozzle 20 is cylindrical such that the part of the metal casing 22 applied against this external wall is vertical and its cross section is constant. Furthermore the central part of the fixed plate 14 includes an insert 42. The outside diameter of the insert 42 is smaller than the diameter of the hole 30 provided in the support plate 13. Consequently, the internal nozzle 20 and the insert 42 may easily be pushed towards the inside of the distributor by sliding over the metal casing 22. The outside part of the fixed plate 14 and the metal casing 22 remain rigidly attached to the slide shutter and the distributor.

I claim:

1. A plate and internal nozzle assembly for a distributor, said plate being adapted to be applied against a support in which there is an orifice, comprising a central area in said assembly facing the orifice and a peripheral area applied on the support, wherein a metal casing at least partially surrounds the central and peripheral areas, the central area and the peripheral area being joined by a connection in said casing that is mechanically weaker than portions of either the central area or peripheral area of the assembly that surround the connection such that a force applied to the assembly will first separate the central area from the peripheral area.

2. A plate and internal nozzle assembly according to claim 1, wherein the connection includes a stamped or notched weakened area in said casing.

3. A plate and internal nozzle assembly according to claim 1, wherein said casing is composed of two separate parts, namely one part partially surrounding the peripheral area, and a part partially surrounding the central area, and said connection is formed at an interface between said two separate parts.

4. A plate and internal nozzle assembly according to claim 1, wherein the internal nozzle includes an external cylindrical or slightly tapered wall, this wall being surrounded by said metal casing.

5. A plate and internal nozzle assembly for a distributor, said plate being adapted to be applied against a support in which there is an orifice, comprising a central area in said assembly facing the orifice and a peripheral area applied on the support, the central area and the peripheral area being joined by a connection that is mechanically weaker than portions of either the central area or peripheral area of the assembly that surround the connection such that a force applied to the assembly will first separate the central area from the peripheral area, said connection being formed by an interface between a round insert in the central area of said plate and the balance of said plate, said insert having a thickness that is about the same as a thickness of said plate and an outside diameter which is smaller than the orifice provided in the support plate.

6. A plate and internal nozzle assembly for a distributor, said plate being adapted to be applied against a support having an orifice, comprising a central area in said assembly facing the orifice and a peripheral area engaged against said support, wherein a metal casing surrounds the internal nozzle of the assembly and a hoop encircles said plate, the central area and peripheral area being joined by a connection defined by an edge of said metal casing that is mechanically weaker than portions of either the central area or peripheral area of the assembly that surround the connection such that a force applied to the assembly will first separate the central area from the peripheral area.

7. An assembly for a distributor having a support with an orifice, the assembly comprising a central area adapted to face the orifice joined by a connection to a peripheral area adapted to be applied against the support, the connection surrounded by a metal casing and mechanically weaker than the central and peripheral areas so that a force applied to the assembly will first break the connection.

8. A plate and internal nozzle assembly for a distributor, said plate being adapted to be applied against a support in which there is an orifice, comprising a plate and nozzle that are integrally formed into an assembly from the same type of ceramic material, a central area in said assembly facing the orifice and a peripheral area applied on the support, the central area and the peripheral area being joined by a connection that is mechanically weaker than portions of either the central area or peripheral area of the assembly that surround the connection such that the central area can be separated from the peripheral area by applying a small force.

* * * * *